United States Patent [19]

Waltersdorf et al.

[11] Patent Number: 4,649,018

[45] Date of Patent: Mar. 10, 1987

[54] CONTAINER FOR THE STORAGE OF RADIOACTIVE ELEMENTS

[75] Inventors: Klaus P. Waltersdorf, Rösrath; Volker Hansson, Cologne, both of Fed. Rep. of Germany

[73] Assignee: Strabag Bau-AG, Cologne, Fed. Rep. of Germany

[21] Appl. No.: 587,916

[22] Filed: Mar. 9, 1984

[51] Int. Cl.[4] ..... G21C 19/00

[52] U.S. Cl. ..... 376/272; 250/507.1; 252/633

[58] Field of Search ..... 376/272; 252/633; 250/506.1, 507.1

[56] References Cited

U.S. PATENT DOCUMENTS

| | | | |
|---|---|---|---|
| 3,493,758 | 2/1970 | Parker et al. | 250/506.1 |
| 3,882,313 | 5/1975 | Siemens, Jr. | 250/507.1 |
| 4,257,912 | 3/1981 | Fleischer et al. | 250/506.1 X |
| 4,291,536 | 9/1981 | Girard | 250/506.1 X |
| 4,292,528 | 9/1981 | Shaffer et al. | 250/506.1 |
| 4,513,205 | 4/1985 | Splinter | 250/507.1 |
| 4,543,488 | 9/1985 | Diem | 250/506.1 X |

FOREIGN PATENT DOCUMENTS

| | | | |
|---|---|---|---|
| 2150569 | 4/1973 | France | 250/507.1 |

OTHER PUBLICATIONS

Printed matter disclosing a plant erected in Germany for radioactive material and a container used therein. Nuclear Engineering International, Aug. 1982, pp. 27–30.

*Primary Examiner*—Peter A. Nelson

*Attorney, Agent, or Firm*—Body, Vickers & Daniels

[57] ABSTRACT

A container for the storage of radioactive elements, more particularly fuel elements or waste from reprocessing plant which produce heat and radiation over a long period of time, which container provides protection from external mechanical action and discharges heat from the radioactive elements, comprising: a block of heat-resistant reinforced concrete in which elongated chambers for receiving the radioactive active elements are arranged together with cooling systems which surround the chambers and which are connected in heat-conducting manner to the chambers to discharge the heat produced by the radioactive elements.

19 Claims, 3 Drawing Figures

CONTAINER FOR THE STORAGE OF RADIOACTIVE ELEMENTS

BACKGROUND OF THE INVENTION

When storing radioactive elements in a transitional or intermediate store, extreme care must be taken to prevent damage being caused by radiation to the environment. Such a store must be capable of withstanding exceptional loads from external events such as earthquakes, explosions, and aircraft crashes. Moreover, radioactive elements produce considerable amounts of heat, which heat must also be dissipated safely.

When used fuel elements from nuclear reactors are to be reconditioned, it is known to store them in thick-walled containers made of spherodial graphite cast iron. These containers are designed to withstand external influences and are set up in a building adapted for such storage, i.e., a building so ventilated that the heat which is produced by the fuel elements and is given off by the cast iron containers to the air can be discharged through the building roof in natural circulation. Transitional stores for elements with vitrified highly radioactive waste are also known wherein a plurality of elements are enclosed in a container made of cast steel. The walls of these containers generally include cooling water pipes connected to a heat exchanger which in normal operation conducts the heat to a utilization stage. The container is situated in a reinforced concrete building dimensioned to withstand external influences or actions, which building also includes an air cooling system with natural circulation to ensure adequate dissipation of heat to outside the containers in the event of failures in the water cooling system.

The heretofore known containers made of cast iron or cast steel do in fact discharge, in a relatively problem free manner, the heat which is produced by radioactive elements, and likewise allow utilization of the discharged heat at temperature levels above 100° C. The manufacture of these containers however is very expensive, as are the materials from which they are made.

SUMMARY OF THE INVENTION

It is the object of the invention to provide a container of the aforementioned type which can be produced cheaply, simply and from inexpensive materials, yet affords a high level of protection against mechanical impingement, can dissipate with air in natural circulation the heat produced by the radioactive elements, and allows utilization of heat with a water cooling system at a temperature level above 100° C.

In accordance with the present invention, a container for storing radioactive material is provided comprising a block of heat-resistant reinforced concrete, having a plurality of elongated chambers therein. Each of the chambers is surrounded by a plurality of cooling air ducts situated at a short distance therefrom, which cooling air ducts ensure an adequate discharge of heat by means of air flowing therethrough. Further, a system of pipes embedded within the concrete for water cooling may additionally be provided for utilization of the dissipated heat, in which case the air cooling serves as an emergency cooling system in the event of a malfunction in the water cooling system.

Such a concrete container comprises materials which afford reliable protection against radiation and are substantially more economical as regards financial cost than cast iron and cast steel. It guarantees a high level of safety as regards stresses, since the loads are spread over a very large number of reinforcing rods which are independent of one another. By arranging a large nunber of cooling ducts around the chambers containing the radioactive elements at a small spacing therefrom, it is possible to take away the heat produced by the radioactive elements without overheating of the elements.

A small spacing between the cooling air ducts and the radioactive element chamber also allows adequate transmission of heat in the concrete. If a relatively considerable spacing is required, e.g. for better shielding against radiation, metal parts may be provided within the concrete between the cooling air ducts and the chambers which metal parts act as heat bridges and as radiation shielding means. These metal parts can be constructed as plates. The metal plate shields the cooling air duct from the chamber and extends near to the chamber, so that it forms a heat bridge between the chamber and the cooling air duct.

Since containers of this kind are intended to have a very long working life, it is advantageous to provide the chambers with a lining of special steel. Two constructional variants can be considered for this purpose: either a special steel lining with appropriate anchoring elements for security against shear can be concreted-in directly, or such a lining may be inserted subsequently into a suitably prepared cavity. Since, after its initial heating-up after insertion of the radioactive elements, the container is subjected only to small temperature changes, it is possible for the steel linings of the chambers to be anchored directly in the concrete even with high operating temperatures above 100° C., since in view of the small number of temperature stress alternations there is adquate surety against fatigue of the steel.

The cooling air ducts may be constructed as simple tubular conduits in the concrete, and can have surfaces which are pervious to air and vapors, such that the water driven out at the first heating of the concrete can be taken away. Likewise, cooling air ducts and/or the chambers may comprise prefabricated concrete elements which are permanently embedded within the concrete block.

Further in accordance with the present invention, to obviate the splitting-off or breaking-off of pieces from the concrete surfaces of the cooling air ducts under the thermal action of the fuel elements or when the container is subjected to mechanical stress, with the danger of such pieces blocking the cooling air ducts and reducing their efficiency, the cooling air ducts are lined with metal over at least a portion of their inner wall surface. The metal linings of the chamber and of the cooling air ducts can be connected in thermally conductive member to one another by metal pieces. If one of the linings of the chambers on the one hand is comprised of relatively corrosion resistant steel and the cooling air ducts on the other hand are comprised of a steel of lower quality, an insulation to prevent contact corrosion may be provided between the metal pieces for thermally conductive connection of the linings of the chamber and the cooling air ducts.

As previously mentioned, it is also possible to provide additional concreted-in cooling water pipes, through which water flows, to utilize the heat given off by the radioactive elements. The cooling water pipes can surround the chambers helically, and can be in thermally conductive connection with the lining of the chambers and/or the lining of the cooling air ducts. In the case of such a constructional form, heat losses can be reduced if the concrete block is provided at its outer periphery with a heat-insulating jacketing. If the cooling air ducts are fully provided with metal linings it may be necessary to provide a plurality of additional or secondary ducts for reducing the vapor pressure, these being distributed in the concrete of the block over the cross-section thereof. The distribution of the cooling air ducts and possibly further additional or secondary ducts over the entire concrete cross-section prevents considerable vapor pressure over a large area in the several meters thick concrete of the container even at the first heating of the concrete block above 100° C.

Reduction of the vapor pressure in the concrete through the cooling air ducts is also possible when these are partly lined with metal. Such partial lining prevents concrete surface layers from flaking off.

The block of heat-resistant reinforced concrete can include one or more working passages or shafts distributed over its cross-section, from which the concrete can be introduced section-by-section even in the case of very high containers, and which can be used as air guide ducts and for inspection purposes during operation of the container. This is necessary if prefabricated elements as chamber linings with cooling water pipes and with the cooling air ducts associated with them are assembled as a unit with close spacing before the introduction of the concrete. If prefabricated concrete elements for cooling air ducts and heavy metal parts as radiation shielding means and as heat bridges are provided, these parts are incorporated in sections in accordance with the height of the concreting sections.

To prevent deformation phenomena arising from temperature variations and which may occur in the container from transmitting unallowable stresses to the structure or building surrounding the container, an appropriate bearing arrangement is provided. A supporting annular wall with air throughflow apertures, or a plurality of ring segments arranged with spacing between one another in the circumferential direction, is provided in an air admission chamber with which the cooling air ducts in the block communicate. Suitably yieldable lateral supports for the surrounding building can be provided additionally.

BRIEF DESCRIPTION OF THE DRAWINGS

These and other objects and advantages will become apparent from the description of a preferred embodiment of the invention illustrated in the accompanying drawings in which:

FIG. 3 is an enlarged view of detail III shown in FIG. 2, which enlarged view illustrates six different embodiments of the cooling air ducts and also different constructions of heat bridges, cooling water pipes and the like.

DETAILED DESCRIPTION OF A PREFERRED EMBODIMENT

Figure 1:
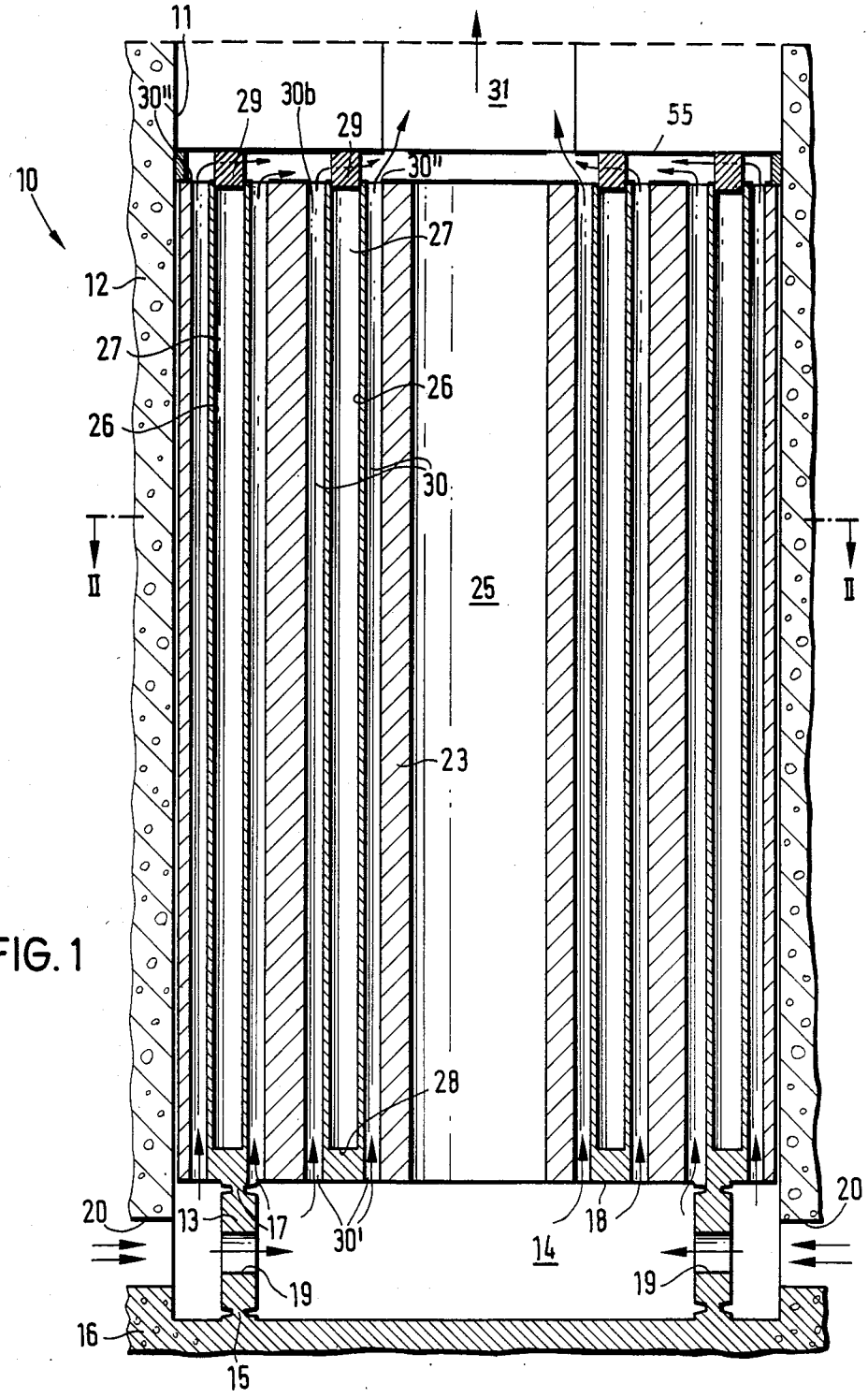
FIG. 1 is a sectional view of a container for radioactive elements according with the present invention.

Referring now to the drawings wherein the showings are for the purpose of illustrating a preferred embodiment of the invention only, and not for the purpose of limiting same, FIG. 1 shows a container 10 for radioactive elements which is arranged in a vertical situation in a cylindrical cavity 11 of a concrete structure or building here indicated only by its walls 12 and not otherwise illustrated. The container 10 rests on a supporting annular wall 13 made of reinforced or prestressed concrete which is arranged in an air supply chamber 14 situated in the lower portion of the cylindrical cavity 11 in the building 12. The supporting annular wall 13 is connected by a concrete joint 15 on the one hand to the base slab 16 of the building 12, and with a joint 17 to the underside 18 of the container 10 on the other hand, and is provided with air throughflow apertures 19. The air supply chamber 14 also has lateral air entry apertures 20 which communicate with air supply ducts 21. As heat seen in FIG. 2, ducts 21 are formed by the inner wall of cylindrical cavity 11 in building 12 and by outwardly open recesses in the outer periphery 22 of the container 10.

Figure 2:
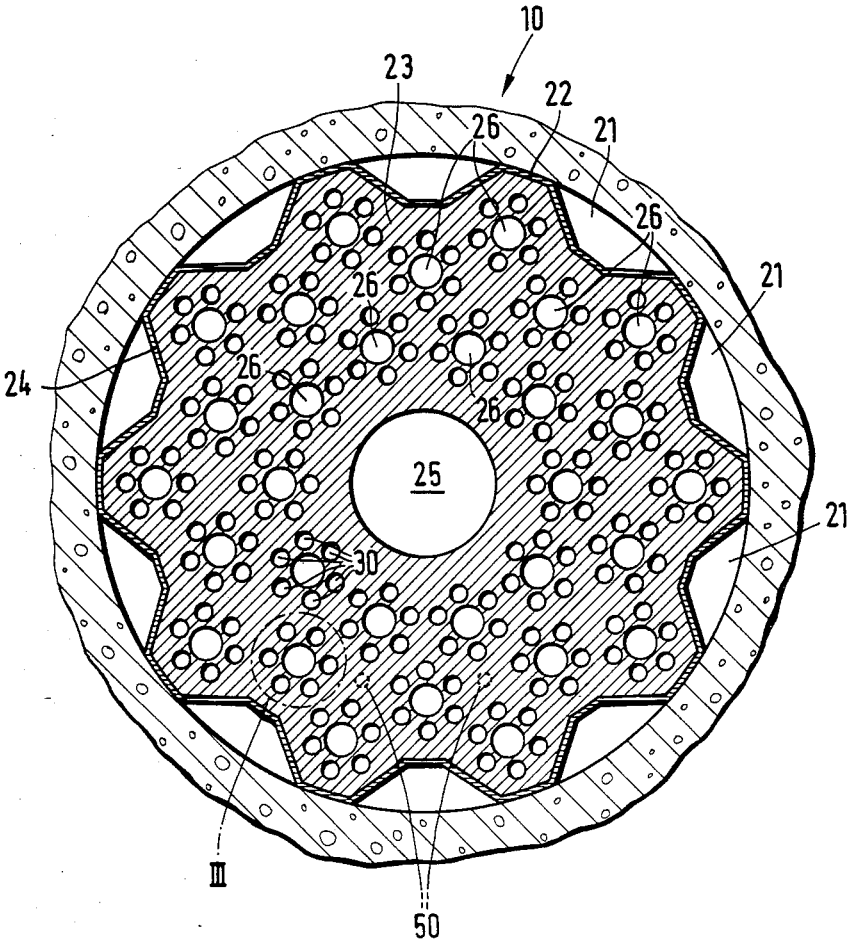
FIG. 2 is a cross-sectional view taken along line 2—2 of FIG. 1.

The container 10 comprises an elongated block 23 of heat-resistant reinforced concrete which is arranged in a vertical situation in the cavity 11 of the building 12 and has an annular cross-section with an external periphery indented in star-shaped form. As best seen in FIG. 2, concrete block 23 is generally cylindrical in shape, and in the outer peripheral surface 22, trapezoidal-section working shafts 21 which extend along the length of the block are provided, which shafts 21 can also be used as air supply ducts. The concrete block 23 can be provided at its entire outer peripheral surface 22 with a heat-insulating jacketing 24.

Situated in the center of the container 23 is an axially disposed cylindrical working shaft 25 which extends through the container 23 from top to bottom and from which the concrete is introduced when the container is being made, and which can be used for inspection work once the container is finished.

Surrounding working shaft 25, in three concentric circles, a plurality of cylindrical chambers 26 are provided for accommodating radioactive elements 27 (FIG. 1), which chambers extend over almost the entire height of the container 10. Chambers 26 are closed at their lower end 28 and are provided with a closure plate 29 at their upper end for sealing the chamber. Each chamber 26 is surrounded by six cooling air ducts 30 which are arranged at a small spacing from the chamber 26 with which they are associated, and which extend parallel to the chamber 26. The cooling air ducts 30 extend over the entire height of the container 10 and at their lower end 30′ communicate with the air supply chamber 14 and at their upper end 30″ with an air discharge chamber 31 which is connected to air discharge conduits provided in the building but not shown here. These conduits discharge the heated air into the free atmosphere or feed it to a heat exchanger.

Figure 3:
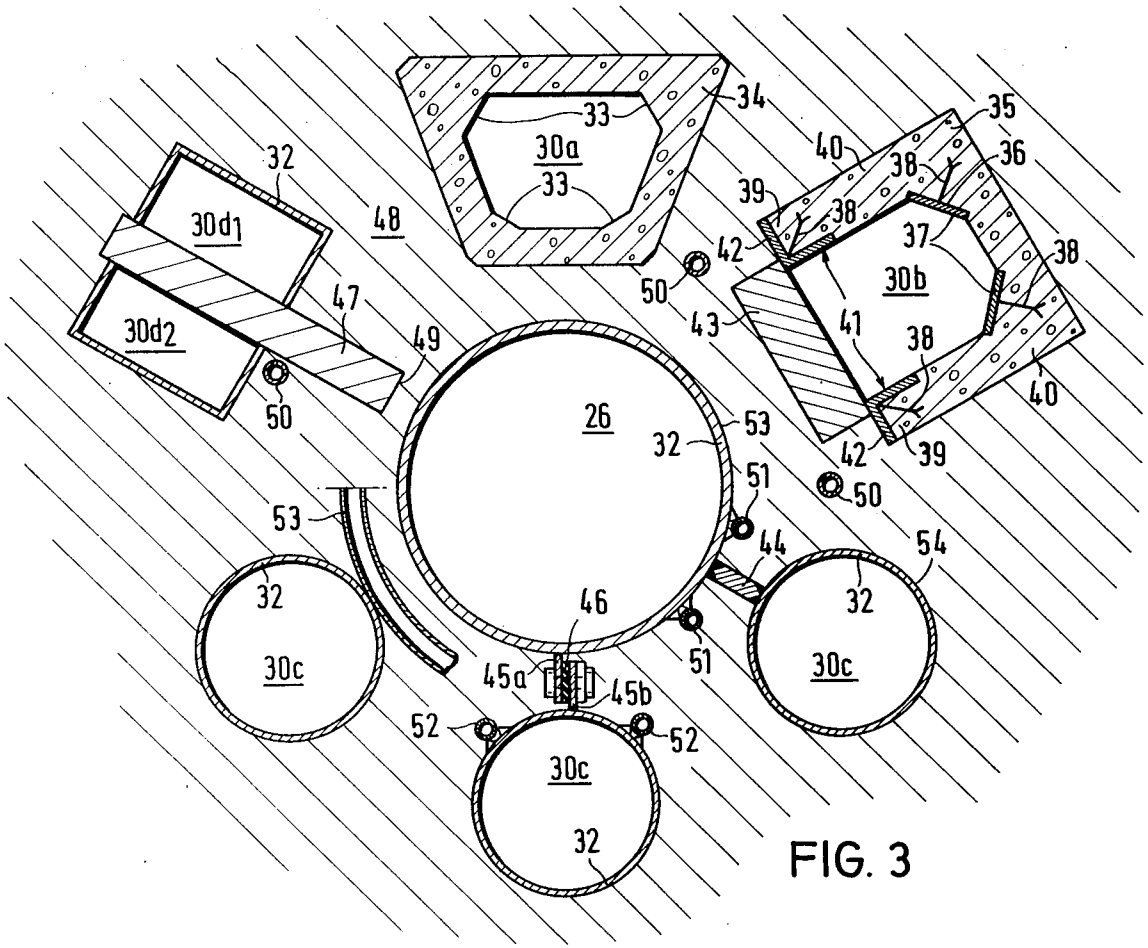

The cooling air ducts 30 can be simply conduits formed in the concrete, in which case it is preferably to make them as prefabricated concrete parts which are left embedded in the concrete of the container as lost formwork. While chambers 26 have to be adapted to the cross-section of the radioactive elements 27 to be contained therein, the cooling air ducts 30 may have various cross-sectional forms, and may be for example circular, square or trapezoidal, and the inner corners may be rounded or bevelled. FIG. 3 shows various constructional forms of cooling air ducts, which will be described in more detail hereinafter together with the construction of the chambers 26 and other additional items of equipment.

FIG. 3 shows a chamber 26 in cross-section which is provided with a cylindrical lining 32 of relatively corrosion resistant steel. Four different cooling air ducts 30*a*, 30*b*, 30*c*, and 30*d* are arranged around about chamber 26. It should be pointed out that these ducts represent alternate embodiments, and that only one of the various kinds of cooling air duct is used in the construction of a container.

Cooling air duct 30*a* is of generally trapezoidal cross-section with bevelled-off corners 33 and is formed of a prefabricated concrete element 34 in the form of a trapezoidal ring. The concrete element can extend over the entire height of the container 10, or may also be composed of a plurality of lengths a few meters long which are conveniently connected together at assembly. The concrete element itself is provided with a reinforcement not shown here, and in the site concrete between the concrete elements 34 and the chamber 26 there is also situated a slack and/or prestressed reinforcement, but this is not shown here. Both the concrete of the prefabricated elements 34 and also the site concrete between the concrete elements and the fuel element chambers 26 are pervious to air and vapor, and are made for example with additives comprising boiler slag or blast furnace slag, so that after the first insertion of fuel elements into the chambers 26 and the subsequent heating of the container 10 the water or moisture expelled from the concrete can enter the cooling air ducts 30*a* and be discharged via the ducts together with the throughflowing air.

Cooling air duct 30*b* has a substantially rectangular cross-section and is surrounded on three sides by a prefabricated concrete element 35. The concrete element 35 has a substantially U-shaped cross-section whose inner edges 36 are bevelled and are armoured with steel plates 37 which are secured in the concrete element 35 with anchoring elements 38. At the free edges 39 of the limb portions 40 of the concrete element 35 steel rails 41 in the form of angle sections are arranged which are secured with anchoring elements 38 in the concrete element 35. At the faces 42 of limb portions 40 a rough plate 43 of simple cast iron or steel is arranged. Plate 43 covers the cooling air duct 30*b* at the side thereof directed towards the chamber 26, and can be welded to the angle sections 41. The metal plate 43 serves as a heat bridge for heat transfer from the chamber 26 to the cooling air duct 30*b*, but is arranged at a spacing from the relatively corrosion resistant steel lining 32 of the chamber 26 so that between these two materials no contact corrosion can occur.

Cooling air ducts 30*c* are provided, like the chamber 26, with a metal lining, which in the case of the cooling air duct 30*c* at the lower right in FIG. 3, comprises corrosion resistant steel but in the cooling air ducts below and at the lower left in FIG. 3, comprised ordinary quality steel. The metal linings 32 of the chamber 26 and of the cooling air ducts 30*c* are connected by metal pieces 44 and 45*a* and 45*b* in thermally conductive mannter. The metal pieces 44 which connect the corrosion resistant steel linings of chamber 26 and air duct 30*c* to one another can be connected directly to these linings, for example by welding thereto. The metal pieces 45*a* and 45*b* which connect the relatively corrosion resistant steel lining of the chamber 26 to an ordinary steel lining 32 for the air duct 30*c* are separated from one another by an insulation 46 to prevent contact corrosion.

. Cooling air duct 30*d* shown in the left upper corner of FIG. 3 has a substantially square cross-section and a metal lining 32 of sheet steel. It is sub-divided by a cast iron plate 47 over its entire length into two part-ducts 30*d*$_1$ and 30*d*$_2$. The cast iron plate 47 projects beyond the cooling air duct 30*d* in a direction radially with respect to the chamber 26, and projects into the site concrete 48 of the block 23, so that its free edge 49 is situated at a very short distance from the outer surface of the metal lining 32 of chamber 26. This arrangement allows good transfer of heat from chamber 26 to cooling air duct 30*d*.

Since vapor diffusion into the cooling air ducts 30 is not possible if the metal lining 32 of the chambers 26 and cooling air ducts 30*c* and 30*d* is continuous, the vapor pressure occurring at the first heating of the concrete container must be reduced in another way. In that case a plurality of additional or secondary ducts 50 are provided in the site concrete of the block 23 and are distributed over the entire container concrete cross-section, but only a few of these additional ducts are shown in FIGS. 2 and 3.

To allow making use of the heat given off by the fuel elements stored in the chambers 26, cooling water pipes 51 and 52 through which water flows can be provided between the chambers 26 and their cooling air ducts 30. If the chambers 26 and cooling air ducts 30 are provided with metal linings 32 these cooling water pipes can be secured directly to the outsides 53 and 54, respectively, of these linings, for example by welding. The direct metal contact ensures a good transfer of heat. But it is equally possible to arrange these cooling water pipes in the concrete. The cooling water pipes are connected to a heat exchanger which is not shown here and which takes up the heat from the pipes and delivers it for example to a district heating system.

Instead of the cooling water pipes which are shown in the lower right hand region in FIG. 3 and which run vertically through parallel to the longitudinal axis of the chambers 26 and the cooling air ducts 30, it is also possible to provide cooling water coils 53 which surround the chambers along helical lines and are arranged concentrically with respect to the chambers 26.

At its top end the container 10 is covered with a platform 55 from which the chambers 26 can be charged with the fuel elements 27. The relatively corrosion resistant steel walls of the chambers 26 are taken through this platform and are connected to it. The closure means provided for the chambers are so constructed that they can be operated from the platform and are still situated in the region of the chamber 26 which is supported by concrete. The space between the platform 55 and the top edge of the concrete container 10 and also between the chambers 26 serves as part of the air discharge system.

It will be appreciated that the present invention is not limited to the constructional examples which have been described and illustrated and these and other modifications and alterations are possible without departing from the framework of the invention. For example it is possible instead of a central shaft to provide a plurality of working shafts distributed over the cross-section of the container. Other cross-sectional forms are also possible both for the chambers and also for the the cooling air ducts, and the arrangement of the cooling water pipes and the arrangement of the cooling air supply and discharge ducts may also differ somewhat. It is intended that all such modifications and alterations be included insofar as they come within the scope of the invention as claimed or the equivalence thereof.

Having thus described the invention, it is claimed:

1. A container for storing radioactive elements comprising a heat resistant, reinforced concrete block, said block having a plurality of horizontally spaced, elongated storage chambers extending vertically therein, each of said chambers being closely surrounded by a plurality of cooling ducts extending through said block, said ducts being generally parallel to said chambers and connected at one end to an air supply, and at the other end to an air discharge, said air supply being fed by natural convection from the atmosphere at said container, said cooling ducts thereby completing a convective air flow path from the atmosphere of said container through said air supply and said ducts to said air discharge.

2. A container as defined in claim 1, wherein said cooling ducts are constructed as simple tubular conduits in said concrete.

3. A container as defined in claim 2, wherein said ducts and said storage chambers are made of prefabricated concrete elements which are embedded in said block.

4. A container as defined in claim 3, wherein said ducts are provided with a metal lining over a portion thereof.

5. A container as defined in claim 1, wherein each storage chamber and its surrounding cooling ducts includes heat conductive members situated therebetween to dissipate heat from said chamber to said cooling ducts.

6. A container as defined in claim 5, wherein said cooling ducts have metal linings along the surfaces thereof and said heat conductive members are connected in a thermally conductive manner to said metal linings.

7. A container as defined in claim 6, wherein said heat conductive members define portions of said cooling ducts.

8. A container as defined in claim 5, wherein said storage chambers and said cooling ducts have metal linings along the surfaces thereof, and said heat conductive members directly connect in a thermally conductive manner each of said chambers with the cooling duct surrounding said chamber to form a heat bridge therebetween.

9. A container as defined in claim 8, wherein an insulation to prevent contact corrosion is provided between said heat conductive members and said storage chamber.

10. A container as defined in claim 8, wherein an insulation to prevent contact corrosion is provided between said heat conductive member and said cooling ducts.

11. A container as defined in claim 1, further comprising cooling pipes located between said storage chambers and said cooling ducts, said cooling pipes extending through said block and having a liquid flowing therethrough to take up heat given off by the radioactive elements.

12. A container as defined in claim 11, wherein said cooling pipes are parallel to said storage chambers.

13. A container as defined in claim 11, wherein said cooling pipes surround said storage chambers and are arranged in helical formation.

14. A container as defined in claim 11, wherein said storage chambers include a metal lining over at least a portion thereof and the cooling pipes surrounding a storage chamber are connected in heat-conducting manner with the metal lining thereof.

15. A container as defined in claim 11, wherein said cooling ducts include a metal lining over at least a portion thereof and said cooling pipes are connected in heat-conducting manner with said metal lining.

16. A container as defined in claim 1, wherein said storage chambers extend vertically through said block, and said cooling ducts are generally parallel to said storage chambers and arranged symmetrically thereabout.

17. A container as defined in claim 1, wherein a plurality of secondary ducts are arranged within said block and extend therethrough to reduce vapor pressure within said block.

18. A container as defined in claim 1, wherein said cooling ducts are prefabricated concrete elements having a generally U-shaped cross-section having leg portions extending toward said storage chamber, said U-shaped duct having metal plates anchored along its inner edges and having a heat conductive member spanning said leg portions and defining a portion of said duct.

19. A container as defined in claim 1, wherein said container is housed in a surrounding structure, said container is elongated, vertically oriented, and closely fitted within a cavity formed in said structure, said block having laterally spaced, vertically extending indentations formed in the peripheral surface thereof, said indentations extending the height of said block and forming ducts between said block and the wall surface of said cavity, said ducts being connected at one end to said air supply and at the other end to said air discharge, said ducts thereby completing a convective air flow path from the environment of said structure through said air supply and said ducts to said air discharge.

* * * * *